United States Patent [19]

Almgren

[11] 4,201,492

[45] May 6, 1980

[54] LOOSE LEAF BINDER LOCK AND OPERATING MEMBER THEREFORE

[75] Inventor: Robert Almgren, Chatham, N.J.

[73] Assignee: American Loose Leaf Corp., Clifton, N.J.

[21] Appl. No.: 923,366

[22] Filed: Jul. 10, 1978

Related U.S. Application Data

[63] Continuation of Ser. No. 758,068, Jan. 10, 1977, abandoned.

[51] Int. Cl.[2] ..... B42F 3/00

[52] U.S. Cl. ..... 402/54

[58] Field of Search ..... 85/5 B; 16/126; 402/46–48, 54, 60, 64, 65

[56] References Cited

U.S. PATENT DOCUMENTS

| | | | |
|---|---|---|---|
| 1,598,837 | 9/1926 | White | 16/126 |
| 1,700,613 | 1/1929 | Meigs | 16/126 |
| 2,286,060 | 6/1942 | Buenger et al. | 402/54 |
| 2,327,873 | 8/1943 | Dawson | 402/54 |
| 2,472,969 | 6/1949 | Guinane | 402/54 |
| 2,568,227 | 9/1951 | Federbush | 402/54 |

*Primary Examiner*—Paul A. Bell

*Attorney, Agent, or Firm*—Stephen E. Feldman; Marvin Feldman

[57] ABSTRACT

A loose-leaf binder is disclosed having a pair of separable cover members with rib portions and a centrally disposed fastening sleeve assembly disposed for insertion through a central aperture in the rib. An outer sleeve of said fastening sleeve assembly is tapered at one of its extremities to coact with ball locks carried by an inner sleeve member which is slidably disposed for limited longitudinal movement within said outer sleeve, and which is hollow at one of its extremities to receive the locking pin. The operating extremity of the inner sleeve member is provided with a transverse aperture which passes diametrically therethrough to receive an operating member in the form of a ring which is sized so that it will not interfere with closing of the cover no matter what the rotative position of the ring when disposed in the inoperative position which is flat, parallel to and in contact with the rib of the closed binder. The leg of the ring interconnecting same to the operating end of the inner sleeve is sized to pass completely through the ring connecting aperture formed therein and in contact with the rib. Alternatively the inner sleeve may be provided with the aperture through which the operating member passes without the need for the extending pin.

9 Claims, 6 Drawing Figures

LOOSE LEAF BINDER LOCK AND OPERATING MEMBER THEREFORE

This application is a continuation of U.S. Ser. No. 758,068 filed Jan. 10, 1977, now abandoned.

BACKGROUND OF THE INVENTION

1. Field of Application

This invention relates to pin or post type loose leaf binders and more especially to operating members for the releasable binder locks thereof.

2. Description of the Prior Art

A significant number of books are made available to the public in a loose-leaf format. This is especially true for professional and business books and literature of the type which must be updated on a regular basis such as yearly or the like. There are many services providing such material and it has been found to be of great advantage and much less costly to be able to merely add and substitute some pages of text rather than replace the entire book.

The very familiar three, or five, ring binder is sometimes used for such texts; but such binders were found to present significant limitations for sizable texts. In addition the rings often became unaligned and the opening and closing mechanisms easily became either difficult or impossible to operate.

In the alternative, wide use has been found for post type loose-leaf binders wherein the binder is formed from a front cover section and a back cover section which are releasably secured together to form the binder and which are separable, one from the other, for the purpose of filling or changing the contents of the binder. Each cover section, of such post or pin type binders, usually include a cover member and a side flange or spine member interconnected one to the other in a hinged manner to facilitate opening and closing of the binder. A rib is usually carried by each side flange so as to extend substantially along the length thereof parallel to and in proximity to the hinge. The rib carried by the side flange of the rear cover section usually carries a pair of spaced posts, or pins, adapted to receive the leaves of the text, which have been appropriately punched; as well as a centrally disposed locking post. A narrow plate, also usually provided for such binders, is formed with a relatively large centrally disposed fastening sleeve receiving aperture and a pair of spaced posts, or pins, also adapted to pass through the appropriately punched leaves of the text. The fastening sleeve assembly is carried by the rib of the front cover section in a central position and is formed with an outer sleeve inwardly tapered at its lowest extremity, and a hollow inner sleeve to receive the locking post. It is further provided with a plurality of balls adapted to grip the locking post to releasably secure the members together. A spring urges the inner sleeve into its locking condition, an extending pin is positioned in the sleeve so that it extends out the other extremity of the inner sleeve, while an operating member, usually in the form of a ring, is connected to the extending pin to facilitate movement thereof against the spring action to release the lock.

In most of such post type loose-leaf binders, such as shown in U.S. Pat. No. 1,869,790 granted to Walter F. Wolf on Aug. 2, 1932 for Loose Leaf Binder And Lock, in U.S. Pat. No. 2,308,363 granted to James P. Guinane on Jan. 12, 1943 for Loose Leaf Binder Locking Mechanism and in U.S. Pat. No. 2,568,227 granted to Max W. Federbush on Sept. 18, 1957 for Loose-Leaf Binder, the operating ring is made large enough to allow a finger of the user to pass through the ring. Such rings have, however presented problems in that they must be carefully positioned prior to closing the front cover of the binder or either the ring or cover, or both, may be damaged and further use of the binder impaired. The user of binders with such relatively large rings is forced to remember to rotate the ring so that when placed in an inoperative position, it is parallel to the closed cover or otherwise if it is perpendicular it will not fold down when the binder is closed and will either be bent or will tear through the cover of the binder.

Some binders, such as shown in U.S. Pat. No. 3,288,143 granted to Max W. Federbush and Alexander P. Federbush on Nov. 29, 1966 for Loose Leaf Book Lock, have attempted to control and cure this problem by constraining the operating inner sleeve to sliding motion only to thus maintain the ring in an aligned condition. However, users of these binders normally believe it necessary to turn the ring even though it is constrained against turning and thus when opening the binder forceably turn the ring. This turning either removes the ring from the post and causes the post mechanism to become partially disassembled or destroys the post mechanism itself.

In many of these binders, such as the one shown in said U.S. Pat. No. 2,568,227 the operating ring is bent in a circle with the split ends abutting and passes completely through the operating end of an inner sleeve. The ring will often position itself so that split in the ring is in the opening in the sleeve.

Disposition of the ring split within the hole of the operating end of the sleeve member presents problems in and of itself because the forces applied to the ring, to slide the inner sleeve to unlocked condition, sometimes result in separation of the ring ends and of the ring from the sleeve. Subsequent replacement is sometimes difficult and failure to prevent further use of the binder. This problem is even more pronounced when the operating end of the inner sleeve is merely reassessed to receive spaced ends of an operating ring such as shown in said U.S. Pat. No. 3,288,143. In such mechanisms the inability of the inner sleeve to completely rotate, and the spaced condition of the ring ends very often results in forces upon the ring, when operating same to separate the binder covers, which result in separation thereof from the operating end of the inner sleeve and the aforementioned problems.

SUMMARY OF THE INVENTION

It is therefore an object of this invention to provide a new and improved loose-leaf binder.

It is another object of this invention to provide a new and improved post type loose-leaft binder.

It is still another object of this invention to provide a new and improved releasable locking mechanism for a post type loose-leaf binder.

It is yet still another object of this invention to provide a new and improved operating member for the releasable locking mechanism of a post type loose-leaf binder.

It is yet still a further object of this invention to provide a new and improved ring construction and configuration for the operating member for the releasable locking mechanism of a post type loose-leaf binder.

It is yet still a further object of this invention to provide a new and improved binder having a ring and post which can be rotated without disengagement and removal of the ring from the post.

It is yet still a further object of this invention to provide a binder wherein the ring can be positioned in any direction and the binder closed without damaging the ring or binder covers.

This invention involves releasable locking mechanism for provide a binder wherein the split in the operating member is positioned at a location other than where the member passes through the post.

This invention involves releasable locking mechanisms for releasably securing together the cover members of a post type loose-leaf binder; and more particularly such a locking mechanism wherein a locking post provided upon one cover member is captured within the hollow of an axially slidable inner sleeve carried by the other cover member, and wherein said inner sleeve carries a plurality of balls that are spring urged against a cam surface, formed on an outer sleeve surrounding said inner sleeve, into engagement with said locking post to form the lock. It contemplates providing a pin projecting from the sleeve and an operating member for effecting said axially sliding movement of said inner sleeve such that separation of said operating member from said inner sleeve is effectively prevented and such that said operating member may be disposed in any one of an infinite number of relaxed, or in-operative, conditions without interfering with the closing of the binder.

In carrying out the invention, according to the preferred embodiments, an operating member, in the form of a ring, is formed of a size which is less then the radial distance between the axis of rotation of the binder locking mechanism and the hinge of the binder. Such ring, in addition is formed to pass completely through an operating end of said inner sleeve so that the split between the ends of the ring is disposed at a position removed from such operating end of said inner sleeve as well as that portion of the ring which will usually be grasped by the user.

Other objects, features, and advantages of the invention in its details of construction and arrangement of parts, will be seen from the above, from the following description of the preferred embodiment when considered in conjunction with the drawings and from the appended claims.

DESCRIPTION OF THE PREFERRED EMBODIMENT

For convenience the invention will be described as applied to a post type binder having a pair of covers formed from rigid cardboard stock covered in fabric, with one of such covers provided with a pair of spaced pins for receiving the punched leaves of the leaves of paper to be placed between the covers, and with a removable plate also provided with a pair of spaced pins which are adapted to be received within other punched apertures in such leaves of paper and with a centrally disposed locking mechanism accessable when the front cover is in open condition and with a metallic ring for operating a releasable locking portion of said locking mechansim; it being understood, nevertheless, that without departing from the scope of this invention that the cover members may be formed from and covered in any convenient material, that the one of said cover members and said plate may each carry more then a pair of pins as long as the leaves of paper are appropriately punched, that the locking mechanism need not be centrally disposed, and that the operating ring therefore may be formed from any suitable and convenient material.

Figure 1:
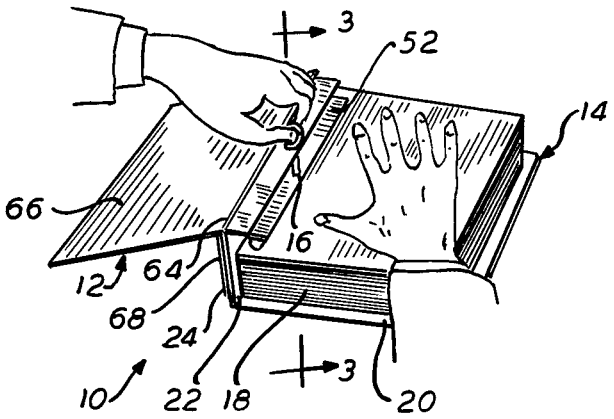
FIG. 1 is a schematic perspective view of a post type binder in its closed condition and which incorporates the instant invention.

With reference to FIG. 1 there is generally shown at 10 a post type loose leaf binder having a first or front cover member 12 and a second or back cover member 14 releasably secured together by a binder cover locking mechanism 16 (FIGS. 1, 3 and 4) and adapted to house therebetween a plurality of leaves of paper 18 of a text or the like.

Rear cover member 14 includes a rear cover panel 20 sized to extend slightly beyond the edges of the paper to be housed in binder 10. A side flange or spine 22 is formed integrally with panel 20 meeting same at a hinge type joint 24 to facilitate rotation of flange 22 to a position disposed at right angles with respect to cover panel 20 when binder 10 is closed and co-planar with panel 20 when binder 10 is open. A pair of pins, or posts, 30 (FIG. 2) spaced from each other and disposed each proximate one extremity of panel 20, are disposed a predetermined distance in from hinge 24. Such distance is selected so that leaves 18 may be punched, as at 32, to receive pins 30 but so that there is enough paper stock about the punch to minimize tearing out of leaves 18. Such distance is generally conventional. The height of pins 30 is selected to accommodate the intended thickness for binder 10. Pins 30 are secured to rear cover panel 20 in a conventional manner similar to that used for a locking post 40 (FIGS. 2, 3 and 4) which also extends up from panel 20.

Locking post 40 is centrally disposed between pins 30 and positioned to receive a centrally disposed aperture also punched in leaves 18. It is secured to panel 20 by a pair of shoulders 42, 44 (FIGS. 3 and 4) which are attached by peaning or other suitable means to back panel 20.

Figure 2:
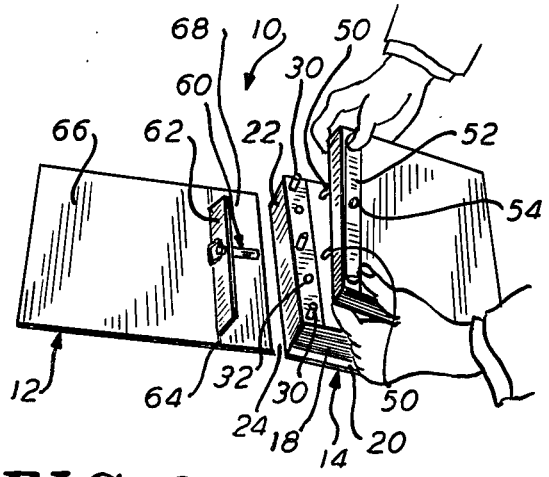
FIG. 2 is a schematic perspective view of the binder of FIG. 1 showing same with its covers in unlocked condition.

Leaves 18 are punched with five spaced holes 32; two to receive pins 30, one to receive locking post 40, and two to receive a pair of spaced pins 50 (FIG. 2) carried by a plate member 52 (FIGS. 1 and 2). Plate member 52 is also formed with an aperture 54 aligned with locking post 40 and adapted to permit passage therethrough of a locking sleeve assembly 60 (FIGS. 2, 3 and 4) carried by a rib 62 disposed parallel and proximate to a hinge 64 of front cover member 12.

Front cover member 12 is formed of stock, covered and sized in a manner similar to rear cover member 14. A front panel 66, of front cover member 12, joins a side flange or spine 68 along hinge 64. Panel 66 and flange 68 of front cover member 12 rotate with respect to each other so as to lay flat when binder 10 is open, and so as to be at right angles with respect to each other when binder 10 is closed.

The respective flanges 68 and 22 of front cover member 12 and rear cover member 14 form the backbone or spine of binder 10. Suitable printing to identify the title, author and publisher of the text may be printed on the exposed surface thereof is so desired.

Locking sleeve assembly 60 includes an outer sleeve 70 rigidly secured to rib 62 by a plug 72 which extends in conventional manner through rib 62 into an opening 74 formed throughout the axial length of outer sleeve 70. An hollow inner sleeve 76, slidably disposed for axial movement within opening 74, is formed at its locking end 78 to receive a plurality of locking balls 80 spaced about the circumference thereof, and at its operating end with an extending flange 81. A pin 82 having a shoulder 83 which mates with flange 81 is positioned in this other end of sleeve 76. A shoulder 84 is formed about inner sleeve 76 to receive a spring 86 which is disposed about sleeve 76 and housed between 84 and plug 72. Spring 86 biases inner sleeve 76 in the direction of arrow A (FIGS. 3 and 4) urging balls 80 against an inwardly tapered cam surface 90 (FIG. 4) formed at the locking extremity of outer sleeve 70.

Alternatively the pin 82 can be eliminated and end of the inner sleeve itself made to form an extending post.

An aperture 94 extends diametrically through pin 82 to receive therethrough an operating member 100 in the form of a ring formed from wire stock. Operating member, or ring, 100 includes a grasping portion 102 formed in substantially semi-circular configuration, and with a leg 104 and an end 106 at one end thereof. The other end of ring 100 includes a leg 108, and an operating arm 110 terminates at an end 112 disposed adjacent the other end 106 of ring 100.

Figure 3:
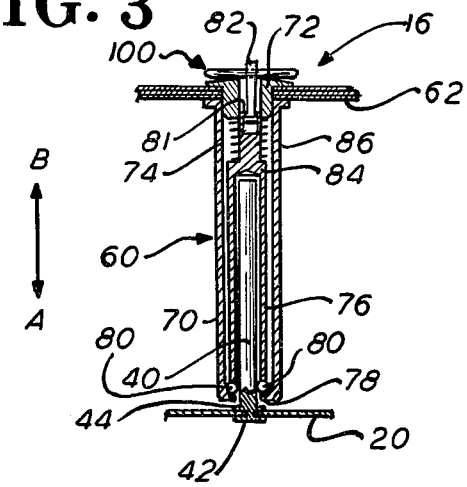
FIG. 3 is a sectional view taken along line 3—3 of FIG. 1 showing the binder cover locking mechanism in locked condition.
Figure 4:
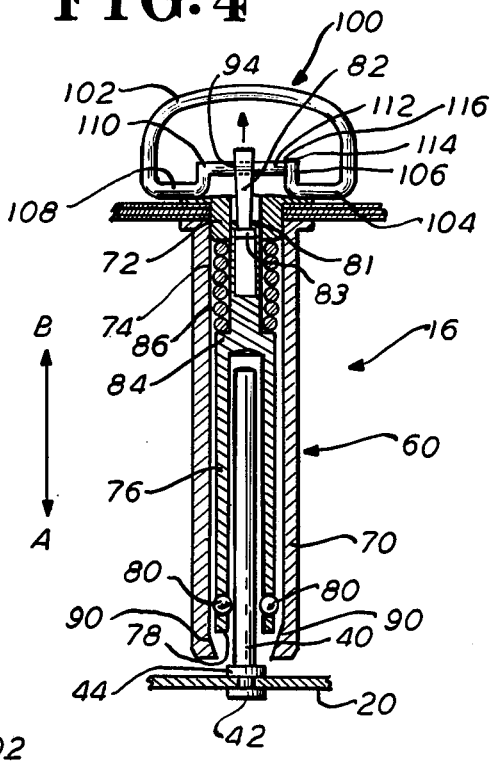
FIG. 4 is a view similar to that of FIG. 3 but slightly enlarged to show the binder cover locking mechanism in released condition but with the cover members still unseparated.
Figure 5:
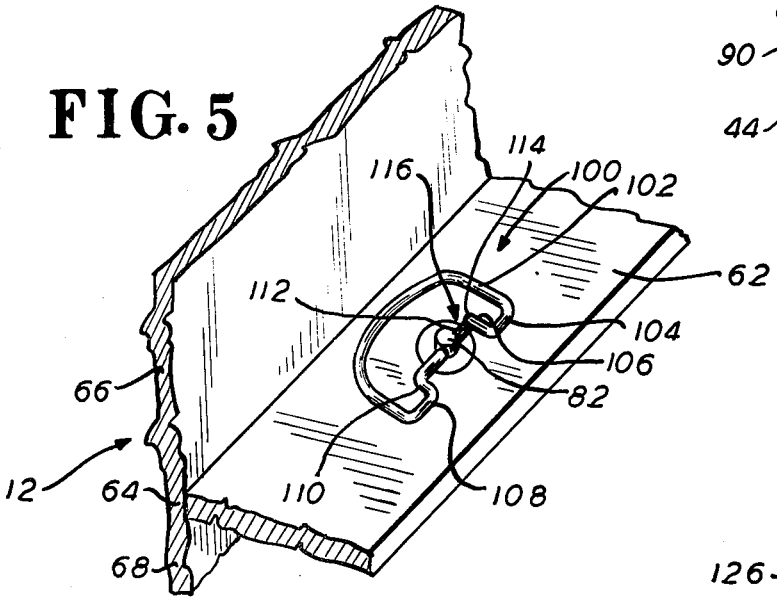
FIG. 5 is an enlarged schematic perspective view of the operating ring for the binder cover locking mechanism showing same in relaxed, or unactuated condition.

The disposition of ring 100 is such that it normally lies in a relaxed or in-operative position, as shown in FIGS. 3 and 5), wherein it is disposed parallel to rib 62 and leaves 18. In such condition and when locking sleeve assembly 60 is disposed about locking post 40 spring 86 urges inner sleeve 76 in the direction of arrow A and balls 80 are moved by cam surface 90 of outer sleeve 70 into gripping contact with locking post 40. Front cover member 12 and rear cover member 14 are thus secured together. It should be noted that this locking mechanism can accomodate a varying stack of leaves 18 as locking sleeve assembly 60 can so grip locking post 40 at any position along the length of post 40.

To release the lock one need only rotate operating ring 100 out of its plane parallel to rib 62. As this occurs legs 104 and 108 thereof coact with the surface of plug 72 such that operating arm 110 rises up with respect to rib 62. The coaction of arm 110 with the inner surface of hole 94 in operation end 82 interconnected to inner sleeve 76 effects a movement of sleeve 76 in the direction of arrow B (FIGS. 3 and 4) against the action of spring 86. Balls 80 move away from cam surface 90 and locking post 40, which is thus released. Front cover member 12 may now be moved away from rear cover member 14. Thereafter plate 52 and its pins 50 may be lifted either with or without a number of leaves 18 and the leaves 18 are now ready for insertion, removal, substitution or the like as the user may please. When such is finished plate 52 is again repositioned and locking sleeve assembly 60 may be replaced about locking post 40.

It is important to note that end 112 of operating arm 110 of ring 100 is disposed outside of aperture 94 of inner sleeve operating end 82. This insures a firm operation of inner sleeve 76 without danger of separation of ends 112 and 106 from each other causing separation of ring 100 from operating end 82. This separation would occur as the ring is being rotated out of the plane parallel to rib 62.

It is further important to note that ring 100 is formed to a configuration such that its most extreme point is radially disposed, from the axis of rotation of inner sleeve 76, a distance which is just under the radial distance of said axis of rotation from the point where rib 62 meets cover panel 66. This enables ring 100 to be positioned at any position about said axis of rotation without ever interfering with the closing of cover member 12. This permits the user to freely rotate the ring without any likelihood of the ring being ultimately positioned so that because of the configuration of the ring the binder cannot close.

Another noteworthy feature in the configuration of ring 100, is the relative disposition of the tips or extremeties 114 and 116 respectively of ends 106 and 112 of ring 100. Tip 116 of end 112 of operating arm 110 extends towards a side of end 106 of leg 104. Tip 114 of end 106 may extend just beyond end 112 or may terminate at any location aproximate same.

Figure 6:
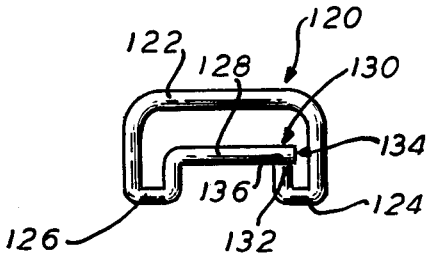
FIG. 6 is a modified form of operating ring.

Ring 100 need not be semi-circular, as shown in FIG. 5, but may instead be box like as shown for ring 120 of FIG. 6. Here again there is a gripping portion 122 with legs 124, 126, an operating arm 128 and ends 130, 132 terminating in tips or extremeties 134, 136 respectively. Ring 120 is connected to operating end 82 of inner sleeve 76 by running operating arm 128 through aperture 94 thereof. It is used as ring 100 and has a configuration which also does not interfere with cover panel 66 no matter what the rotative position of ring 120. It should be noted, however, that the relative location of tips 134, 136 have been shifted (when compared to the showing of FIGS. 4 and 5) so that tip 134 of end 130 of operating arm 128 extends passed but proximate to tip 136 of end 132 of leg 124.

Thus there is disclosed a pair of separable cover members that coact one with the other to house therebetween, and upon a plurality of pins or posts, the punched leaves of a loose-leaf test. Centrally disposed upon one of the cover members is a fastening sleeve assembly disposed for insertion through a central aperture, punshed in such leaves of the text, and for coaction with a locking pin of the other cover member. An outer sleeve of said fastening sleeve assembly is tapered at one of its extremities to coact with ball locks carried by an inner sleeve member which is slidably disposed for limited longitudinal movement within said outer sleeve, and which is hollow at one of its extremities to receive the locking pin. A spring urges inner sleeve member towards said locking pin so that when said locking pin is disposed in the hollow the balls carried by the inner sleeve member are cammed by the taper of the outer sleeve into gripping contact with the locking pin. The other or operating extremity of the inner sleeve member is provided with an aperture which passes diametrically therethrough to receive an operating member in the form of a ring. Said ring is sized so that it will not interfere with closing of the cover no matter what the rotative position of the ring when disposed in the in-operative position parallel to the leaves of the closed binder. The leg of the ring interconnecting same to the operating end of the inner sleeve is sized to pass completely through the ring connecting aperture formed therein.

From the above description it will thus be seen that a novel and improved operating member has been provided for a post type binder; which operating member by being sized less then the radial distance of its rotative axis from the binder cover can be placed in any rotative position without interfering with closure of the cover; and by being formed with an operating arm that extends entirely through the movable locking sleeve minimizes the possibility of separation of the ring from the locking sleeve.

It should be understood that although I have shown the preferred forms of my invention that various modifications may be made in the details thereof without departing from the spirit as comprehended by the following claims:

I claim:

1. A locking mechanism for a binder having a pair of cover members formed with cover panels hinged to side flanges, and which coact one with the other to provide between inner surfaces thereof a binder, said cover members being selectively separable one from the other to facilitate disposition of leaves within the binder; comprising:

(a) a locking post carried by and extending from the inner surface of one of said cover members;

(b) a locking sleeve assembly carried by the other cover member disposed thereon to extend from the inner surface thereof towards and for coaction with said locking post;

(c) said locking sleeve assembly including a hollow outer sleeve connected at one of tis ends to a rib carried by the inner surface of said other cover member and with its other, or locking end, disposed for disposition about said locking pose, and formed with an inwardly tapered cam surface;

(d) said locking sleeve assembly further including an inner sleeve disposed for limited axial movement within said hollow of said outer sleeve, and being formed with a hollow locking end of a configuration to receive said locking post, disposed proximate said locking end of said outer sleeve, and carrying thereabout a plurality of locking balls disposed for coaction with said cam surface;

(e) a spring disposed about an operating end of said inner sleeve and urging same towards said locking end of said outer sleeve such that said locking balls are urged by said sam surface against an outer surface of said locking post, when said locking post is disposed within said hollow of said inner sleeve to secure said locking post and outer sleeve assembly together and thereby the cover members;

(f) said operating end of said inner sleeve extending through said rib and being formed with an aperture diametrically extending therethrough; and (g) an operating member formed from a unitary length of material having a first end and a second end and being formed to a predetermined configuration so as to have an operating portion extending through and rotatably disposed in said aperture of said operating end of said inner sleeve wherein said operating member is in the form of a ring of wire with the operating portion extending radially outwardly away from said operating end, and the first and second ends of said wire meeting at the outward radial end of the operating portion so that neither said first end nor said second end is or can be disposed within said aperture of said operating end of said inner sleeve, said radially extending portion contacts said rib with rotation of the operating portion within the operating end as well as in sleeve rotations, and wherein the ring lies flat on said rib with the cover members closed.

2. The locking mechanism of claim 1 wherein; said operating member includes a gripping portion sized so that no portion thereof extends, radially from an axis of rotation of said inner sleeve, a distance which is greater then the distance of said axis of rotation from the place where said rib meets the cover member carrying same.

3. The locking mechanism of claim 1 wherein; said gripping portion of said operating member is substantially semi-circular in configuration.

4. The locking mechanism of claim 1 wherein; said gripping portion of said operating member is substantially rectangular in configuration.

5. The locking mechanism of claim 1 wherein; said size and configuration of said locking mechanism permits disposition thereof in any rotative position about said axis of rotation without interfering with the hinge action of the cover member carrying same.

6. The locking mechanism of claim 5 wherein said rib is disposed proximate and parallel to the hinge of said cover member.

7. The locking mechanism of claim 1 wherein said operating member is formed from wire.

8. The locking member of claim 1 wherein said ends of said locking member are formed so that one of said ends thereof passes through said aperture and terminates proximate to a tip of said other end thereof.

9. A locking mechanism for a binder having a pair of cover members formed with cover panels hinged to side flanges, and which coact one with the other to provide between inner surface thereof a binder, said cover members being selectively separable one from the other to facilitate disposition of leaves within the binder; comprising:

(a) a locking post carried by and extending from the inner surface of one of said cover members;

(b) a locking sleeve assembly carried by the other cover member disposed thereon to extend from the inner surface thereof towards and for coaction with said locking post;

(c) said locking sleeve assembly including a hollow outer sleeve connected at one of its ends to a rib carried by the inner surface of said other cover member and with its other, or locking end, disposed for disposition about said locking post, and formed with an inwardly tapered cam surface;

(d) said locking sleeve assembly further including an inner sleeve disposed for limited axial movement within said hollow of said outer sleeve, and being formed with a hollow locking end of a configuration to receive said locking post, disposed proximate said locking end of said outer sleeve, and carrying thereabout a plurality of locking balls disposed for coaction with said cam surface;

(e) a spring disposed about an operating end of said inner sleeve and urging same towards said locking end of said outer sleeve such that said locking balls are urged by said cam surface against an outer surface of said locking post, when said locking post is disposed within said hollow of said inner sleeve to secure said locking post and outer sleeve assembly together and thereby the cover members;

(f) said operating end of said inner sleeve extending through said rib and being formed with an aperture diametrically extending therethrough;

(g) an operating member having an operating portion extending completely through said aperture of said operating end of said inner sleeve and extending radially outwardly therefrom, said radially extending portion contacts said rib with rotation of the operating portion within the operating end as well as in sleeve rotations, and wherein the ring lies flat on said rib with the cover members closed; and (h) said operating member includes a gripping portion sized so that no portion thereof extends, radially from an axis of rotation of said inner sleeve, a distance which is greater than the distance of said axis of rotation from the place where said rib meets the cover member carrying same.

* * * * *